United States Patent [19]

Cullen et al.

[11] Patent Number: 4,744,317

[45] Date of Patent: May 17, 1988

[54] MOCK-LINKING APPARATUS FOR JOINING TWO PIECES OF KNITTED FABRIC

[76] Inventors: John C. Cullen; Paul M. Cullen, both of Main Street; Owen Cullen, "The Brackens", all of Manasterevin, Co. Kildare, Ireland

[21] Appl. No.: 74,924

[22] Filed: Jul. 17, 1987

Related U.S. Application Data

[62] Division of Ser. No. 770,265, Aug. 28, 1985, Pat. No. 4,691,537.

[30] Foreign Application Priority Data

Aug. 29, 1984 [IE] Ireland ..... 2203/84

[51] Int. Cl.[4] ..... D05B 35/06; D05B 35/10; D05B 29/00

[52] U.S. Cl. ..... 112/138; 112/147; 112/153; 112/235; 112/27

[58] Field of Search ..... 112/147, 153, 141, 138, 112/235, 25, 27

[56] References Cited

U.S. PATENT DOCUMENTS

| | | | |
|---|---|---|---|
| 1,207,062 | 12/1916 | Magill et al. | 66/172 R |
| 1,352,078 | 9/1920 | Matlack | 66/172 R |
| 1,559,505 | 10/1925 | Currie | 66/172 R |
| 1,852,482 | 4/1932 | Seavers et al. | 112/153 X |
| 1,855,139 | 4/1932 | Sailer | 112/153 X |
| 2,113,763 | 4/1938 | Leimbrock | 66/200 X |
| 2,146,056 | 2/1939 | Dengler | 66/172 R |
| 2,186,885 | 1/1940 | Shpater | 112/153 X |
| 3,320,910 | 5/1967 | Tevyaw | 112/138 |
| 3,370,559 | 2/1968 | Longcore . | |
| 3,476,065 | 11/1969 | Marforio . | |
| 4,128,066 | 12/1978 | Peloggio | 112/27 |
| 4,280,421 | 7/1981 | Price | 112/138 X |

FOREIGN PATENT DOCUMENTS

| | | |
|---|---|---|
| 1113352 | 6/1960 | Fed. Rep. of Germany . |
| 2107722 | 2/1971 | Fed. Rep. of Germany . |
| 2143225 | 8/1971 | Fed. Rep. of Germany . |
| 1386868 | 3/1975 | United Kingdom . |
| 1420231 | 1/1976 | United Kingdom . |
| 1318004 | 5/1978 | United Kingdom . |
| 2004926 | 4/1979 | United Kingdom . |

*Primary Examiner*—H. Hampton Hunter
*Attorney, Agent, or Firm*—Stevens, Davis, Miller & Mosher

[57] ABSTRACT

A mock-linking apparatus is disclosed for linking a specially knitted edging trim in the form of a ribbon of knitted yarn with an unfinished edge of a knitted garment, such as a V-neck opening, to obtain a finish which substantially simulates a point-to-point link finish. The trim is weft-knitted on a double bed knitting machine to incorporate a course of transfer stitches followed by a slack tension course which defines a fold line to facilitate tucking-in of the ravel edge, and an adjacent seam line along the folded edge, wherein the seam line is well-defined by a line of outwardly-protruding loops with spaces therebetween. A conventional chain-stitch sewing machine is used, provided with folding means and guide means to bring the seam line of the trim, which has been folded over the unfinished garment edge, into alignment with the needle path, wherein the two pieces of knitted fabric are joined along the seam line with matching thread. The machine has a foot defining an eye through which the needle may reciprocate, and guide means forward of the eye adapted to advance and impart a slight stretch to the folded over margin portion of the trim in order to open out said spaces defining said seam line just prior to advancement of the seam line to the needle.

4 Claims, 5 Drawing Sheets

Fig. 3.
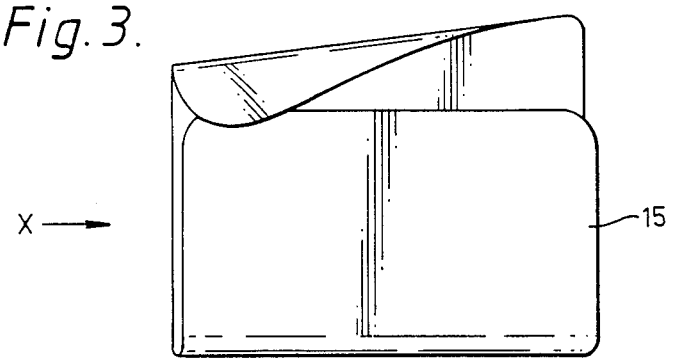
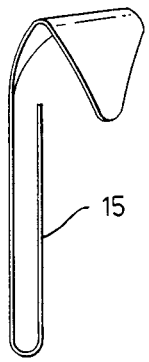
Fig. 4.
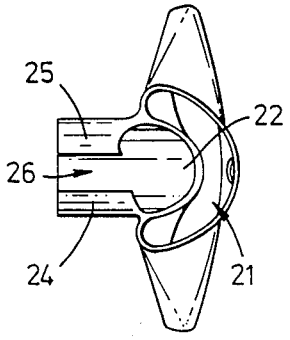
Fig. 6.
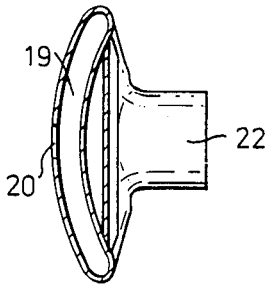
Fig. 7.
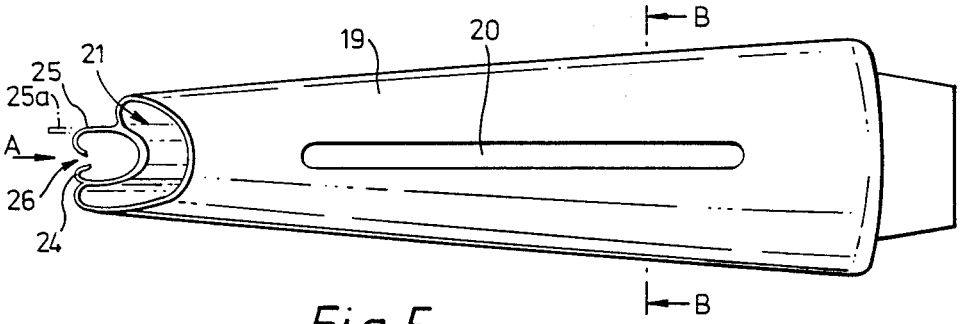
Fig. 5.

MOCK-LINKING APPARATUS FOR JOINING TWO PIECES OF KNITTED FABRIC

This is a division of application Ser. No. 770,265, filed Aug. 28, 1985, now U.S. Pat. No. 4,691,537, dated Sept. 8, 1987.

FIELD OF THE INVENTION

The present invention relates to the machine finishing of garments, in particular to a process and apparatus for mocklinking a knitted trim to an unfinished edge of a knitted garment, to a knitted edging trim for use therewith, and to garments finished by this process.

BACKGROUND OF THE INVENTION

In the knitwear industry, it has been the practice to manufacture a knitted trim for application to an unfinished edge of a knitted garment such as the arm holes of a sleeveless top garment or the neck hole of a V-necked or round-necked pullover. The trim may be knitted in a strip on a warp knitting machine or by making up lengths of trim on a conventional double bed weft knitting machine in a sequence of parallel strips joined loosely together by means of a strong draw thread. Individual lengths of trim are separated by removal of the draw threads and joined end to end to form a continuous ribbon which is then folded into a double or triple thickness before being attached to the unfinished edge of a knitted garment. The attachment process may be carried out manually wherein individual loops on an edge of the trim are linked point-to-point with loops on an unfinished edge of a knitted garment which is a highly skilled and time-consuming operation that is only cost-effective in the case of very high quality knitwear, for example of cashmere. Machines may be used to perform this operation by sewing the trim onto the garment with matching yarn using overlock or overseam stitching, but this results in a rather noticeable join between the trim and the garment and a thick seam on the inside which of course must be suitably finished to prevent fraying of the joined edges. In order to simulate a link finish, machines have been developed to attach a knitted trim to a knitted garment by sandwiching an unfinished edge of the garment between folded over portions of the trim in accurate alignment and machine stitching with matching yarn along a folded edge of the trim in a process known as "mock-linking".

DESCRIPTION OF THE PRIOR ART

Point-to-point linking machines are generally of the rotary dial type, for example, as described in British Patent Specification No. 1,318,004. Such a machine comprises a dial having a bed of radially-projecting impaling pins for reception of consecutive loops of the unfinished garment edge and of the edging strip, which may be doubled over to enclose the garment edge. The strip may be provided with an edge tab or selvedge of thinner elasticated yarn. Because of the fact that the garment edge and strip are held in perfect alignment along a single course of stitching on the impaling pins, linking may be performed by rotating the dial past a stitching station along a regular seam line. If necessary, the seam line in edging strips used with machines of this type may be defined by a single course of matching nylon yarn, thinner than the yarn in which the garment and strip are knitted.

The so-called "mock-linking" machines known from the prior art generally utilise a standard sewing machine to unite the unfinished garment edge to a knitted edging with an ordinary chain stitched seam as this greatly speeds the linking process, but great care has still to be taken to exercise control over the stitching of the seam to keep the two pieces in accurate alignment, so as to ensure that the seam line does not wander off the edging strip, at higher sewing speed. This problem may be overcome by using a magazine comprising projecting impaling pins to receive the garment edge wherein the edging strip is fed via a folder to sandwich the impaled garment edge in accurate alignment prior to linking, as described in U.S. Patent Specification No. 4,128,066.

British Patent Specification No. 2,004,926 B also describes a "mock-linking" apparatus which is primarily concerned with a feed arrangement for bringing the knitted trim and unfinished garment edge together at different tensions to overcome any tendency for an incorrectly tensioned edging to distort the finished garment edge.

A trim or edging strip suitable for use in a mock-linking process may be knitted in various different ways, to facilitate folding and attachment to the unfinished garment edge. The present invention is only concerned with such a trim which has been weft-knitted on a double bed machine, for example in plain rib stitching, double knit. This is distinguished from trims knitted on a single bed, producing a single knit flat fabric, or a single knit "tubular fabric", as described in British Patent Specification No. 1,420,231. In all cases, the trim is defined by two parallel longitudinal edges, the first course knit being a closed loop edge or selvedge, the last course knit being an open loop edge or ravel edge. When the trim is folded over an unfinished garment edge (which may also be a ravel edge), the ravel edge of the trim is tucked in inwardly of the seam line where the trim is to be linked to the garment edge to protect it against fraying or unravelling.

British Patent Specification No. 1,386,868 describes a weft-knitted trim which may be knitted on a double bed machine having a 2:1 needle formation to produce a 2×2 rib stitch pattern over most of its width, with the remainder being knitted on a single needle bed after all loops are transferred to that bed. Thus, a trim is described which essentially consists of a double knit portion and a single knit portion divided by a course of transfer stitches, the latter portion preferably of a thinner yarn. The course of transfer stitches forms all loops of that course to the face side of the trim, while the next adjacent course to be knitted forms all loops of that course to the back side of the trim. This produces a fold or hinge line which facilitates the tucking in of the ravel edge portion against the back side of the trim, but there is the natural tendency of this portion to fold or curl back on account of the fact that it is of a thinner single knit fabric and/or on account of the lower denier yarn employed.

The present invention seeks to improve known knitted edging trims of this type by providing a trim which incorporates a fold or hinge line formed by at least one course of transfer stitching but which also has a definable seam line located closely adjacent to the folded edge adapted to receive a sewn seam of matching thread whereby a point-to-point link finish may be simulated when the trim is machine stitched along the seam line.

SUMMARY OF THE INVENTION

According to the present invention, there is provided a process for linking a weft-knitted trim in the form of a ribbon of knitted yarn with an unfinished edge of a knitted garment, wherein the trim is knitted to incorporate at least one course of transfer stitching spaced from one side edge thereof adapted to define a fold line, the trim then being folded over and linked to an unfinished edge of the knitted garment by machine stitching, characterised in that when folded over along said fold line the folded edge of the trim then presents an adjacent seam line defined by outwardly-protruding loops with spaces therebetween whereby the trim may be linked to the unfinished knitted garment edge using matching thread, such that a mock-link finish may be obtained substantially simulating a point-to-point link finish.

The present invention also provides a knitted edging trim, for use in this process, weft-knitted on a double bed knitting machine in plain rib stitching to incorporate a fold line defined by one course of transfer stitching resulting in a longitudinal kink in the trim which facilitates folding about said kink, characterised in that the course following the transfer course is a slack course defined by a lessening in yarn tension while stitches which have been transferred from a first bed of needles to a second bed of needles of said double bed knitting machine are being taken up again by the said first bed to recommence knitting at the same tension as before in plain rib stitching to terminate with the ravel edge of the trim.

According to the present invention there is also provided apparatus for linking a knitted edging trim, as hereinabove described, in the form of a ribbon of knitted yarn, with an unfinished edge of a knitted garment, comprising a conventional sewing machine in combination with folding means through which the ribbon may be fed to fold over a margin portion of the trim along a pre-formed fold line in the trim spaced from one side edge thereof and to present a seam line adjacent the folded edge, with means to guide the seam line to the path of the needle of the sewing machine.

Preferably, the folding means comprises a pre-folder, to fold over a margin portion of the trim along the said fold line, and a folder to subsequently fold the pre-folded trim in half so as to enclose both sides of the unfinished knitted garment edge, wherein the folder is adapted to turn a ribbon fed therethrough through an angle of approximately 90°–120° as the trim is being folded to enclose both sides of the unfinished knitted garment edge prior to machine stitching so as to facilitate unobstructed alignment of the garment with the trim, such that the outlet of the folder is located closely adjacent to, and in line with the foot of the sewing machine.

Advantageously, the sewing machine includes a modified foot attachment having guide means located on the underside thereof forwardly of the eye of the foot plate adapted to receive the guide the said pre-folded portion of the trim and to align the seam line with the path of the sewing needle, comprising an inwardly projecting lug extending from the underside of the foot plate defining a gap between the foot plate and a portion of the lug sufficient to receive a double thickness of knitted trim.

The present invention also provides a finished knitted garment having a knitted trim around a border thereof and linked thereto by the process or apparatus as herein described.

The mock-linking process provided by the present invention has the advantage over prior art processes of producing a neat finished seam which is practically unnoticeable to the eye and thus is suitable for quality double knit work, at low cost on account of the fact that conventional machinery is employed with the minimum of modification.

The weft-knitted trim utilised by this process has the additional advantage of presenting a seam line closely adjacent to the edge of the trim when folded along the fold line which can be easily aligned with the needle path of a standard chain stitch sewing machine without the need for elaborate garment and trim alignment/tensioning means. Furthermore, the trim can be knitted in such a way as to present a seam line defined by alternating loops and spaces therebetween, to facilitate chain stitching of a seam along said line, which with correct tension, simulates a true point-to-point link finish.

The apparatus used in the process of the invention is of a generally conventional type, as stated above, and is thus simple to operate and does not require a skilled machinist.

BRIEF DESCRIPTION OF THE DRAWINGS

A preferred embodiment of a process and apparatus for mock-linking a knitted trim to an unfinished edge of a knitted garment, in accordance with the invention, will now be described in further detail with reference to the accompanying drawings, wherein:

FIG. 3 shows a front elevation of a pre-folder for use in the present invention, FIG. 4 shows an end elevation of the pre-folder of FIG. 3 viewed in the direction of arrow X, FIG. 5 shows a front elevation of a folder for use in the present invention, FIG. 6 shows an end elevation of the folder of FIG. 5 when viewed in the direction of arrow A, FIG. 7 shows a cross-section of the folder of FIG. 5 when viewed along section line B—B.

DESCRIPTION OF PREFERRED EMBODIMENT

Figure 1:
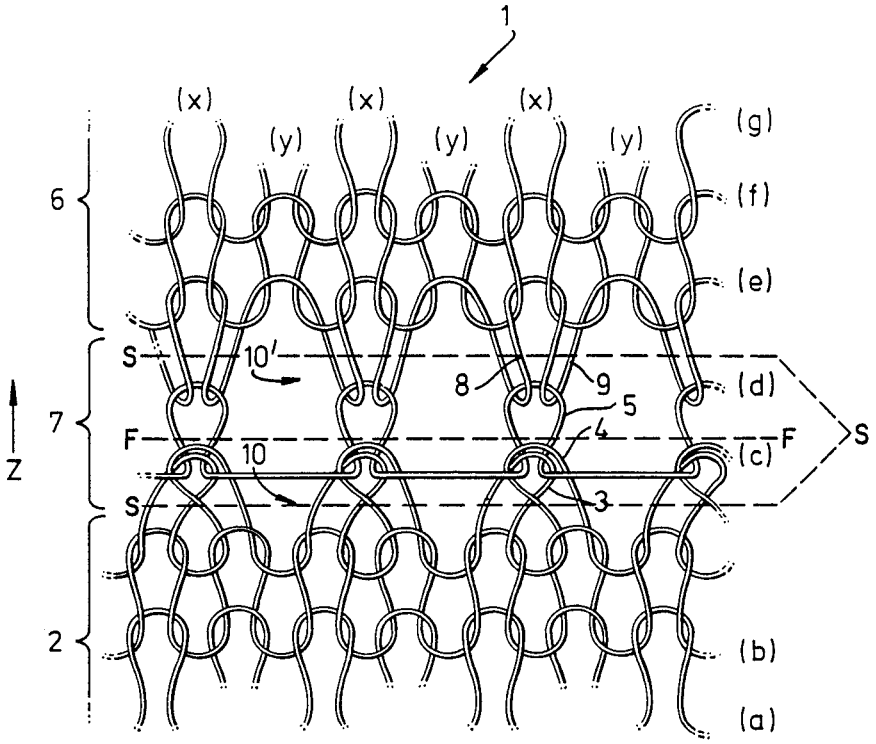
FIG. 1 shows an enlarged portion of a knitted trim in detail.

Referring to FIG. 1 of the drawings, there is illustrated a greatly enlarged portion of a knitted trim 1 suitable for mock-linking to an unfinished edge of a knitted garment. A trim is machine knitted on a double bed or V-bed weft knitting machine such as an H.STOLL GmbH & Co., Reutlingen, W. Germany "AJUM" (Trade Mark) machine using 10 gauge needles to produce a plain rib fabric. The knitted fabric has the same appearance on both sides wherein the wales are displayed as a series of parallel ribs, in contrast to weft-knitted fabric produced by a single-bed machine which is characterised by crosswise ridges on the reverse side with vertical ribs on the face of the fabric. A series of trims of, for example 60 mm width, is knitted in a pre-programmed sequence of edge-to-edge strips joined along their side edges by a strong draw thread knitted into the sequence by a changeover to a different yarn such as terylene polyester. The draw threads are then removed to separate the strips of trim which are subsequently joined end to end by machine stitching to produce a ribbon of trim from which suitable lengths are cut to apply a finish to neck holes or arm holes of unfinished garments.

In FIG. 1, the wales, or vertical lines of loops, are indicated by (x) and (y) wherein wales (x) form raised ribs on the face of the fabric but are displayed as channels on the reverse side, while wales (y) form channels on the face of the fabric but are displayed as ribs on the reverse side. The courses, or crosswise-extending, loop-forming threads, are indicated by (a) to (g). The trim is knitted in the direction of arrow Z, wherein about 50 mm width of fabric is knitted in plain rib stitch as exemplified by courses (a) and (b) forming a main portion 2 of the trim 1. At this point the stitches are transferred from one bed of needles to the other bed during course (c), which is thus a course of "transfer stitches". It will be seen that this has the effect of gathering together pairs of adjacent loops, e.g. loops 3 and 4, of a normal course of rib stitches. The gathered loops 3, 4 are taken up by a "slack course" (d) wherein extra yarn is used to slacken the tension, previously employed when knitting courses (a) to (c), during the return of the cam carriage of the machine following one empty traverse after course (c). The slack course (d) is a row of discrete loops 5 which is in effect a single bed knitted course. Thereafter, courses (e) to (g) are knitted by double bed rib stitching at the same tension as before for about a further 10 mm width to form a margin portion 6 before the trim is finished off at the ravel edge. A single course of draw thread yarn is knitted in at very loose tension before starting the knitting of the next trim in the series.

A trim knitted by the above method is about 60 mm in width and has a kink 7 running along its length formed by the combination of a line of thicker protruding loops, i.e. gathered loops 3, 4 of course (c), and a line of less dense discrete loops 5 of course (d). The kink 7 is spaced by a margin portion 6 of about 10 mm from one side edge of the trim and acts as a fold line F—F by virtue of the fact that loops 5 are less densely packed together than the remainder of the knitted fabric. Furthermore, there is a natural bias for the margin portion 6 to tuck in or fold under the main portion 2 of the trim by virtue of the fact that loops 5 of course (d) underlap adjacent pairs of loops 8, 9 of course (e) (when viewing the face of the knitted fabric as in FIG. 1). When the margin portion 6 is folded under the main portion 2, it will be appreciated that a well defined folded edge is formed by protruding loops 3, 4 of course (c), which has a certain degree of elasticity because of the extra yarn and slacker tension of course (d). Also, the gathering together of pairs of loops 3, 4 in course (c) leaves a larger space 10 between adjacent pairs of loops than between adjacent loops in any of courses (a), (b), (f) or (g), which is matched by the space 10' between adjacent pairs of loops 8,9 in course (e) when margin portion 6 is folded under main portion 2. Thus when the trim 1 is folded over against the back side of the trim along the kink 7, a seam line s—s is presented by a line running through the spaces 10, 10' between pairs of loops 3, 4 and 8, 9, and the intervening overlying gathered pairs of loops 3,4 and 8, 9. When machine stitching along this seam line the chain stitch spacing is preferably adjusted to correspond with the distance between the spaces 10, 10' between the pairs of loops 3, 4, and 8, 9 with the thread preferably passing through the fabric at the spaces 10, 10' to give a neat finished seam. It will also be appreciated that when folded over along kink 7, the trim presents a seam line which is almost at the very edge of the folded trim, such that when linked to an unfinished edge of a knitted garment by machine stitching as described above, using thread in a matching colour, a mock-link finish may be obtained which simulates a point-to-point link finish. That is to say, a substantial number of individual groups of gathered pairs of loops 3, 4 and 8, 9 are linked directly to the garment fabric by individual loops of the chain stitch seam.

Referring now to FIGS. 2 to 11 of the drawings there will be described apparatus suitable for mock-linking a knitted trim as described above to an unfinished edge of a knitted garment. In practice, the garment itself may be of any fabric or material but normally it will be desired to use the apparatus to obtain a true mock-link finish with a garment knitted in the same stich and yarn as the trim.

Figure 2:
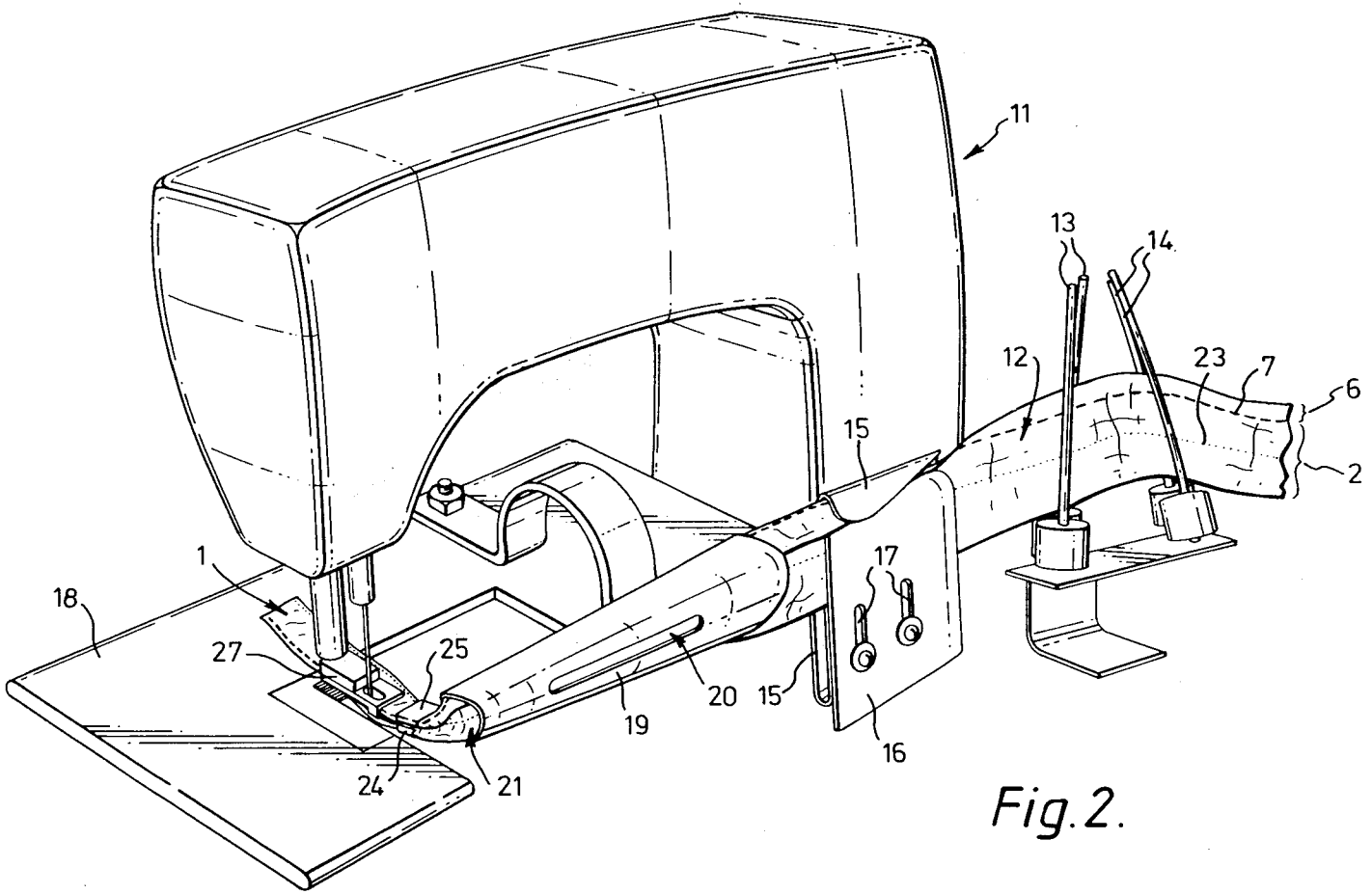
FIG. 2 shows a ribbon of the knitted trim of FIG. 1 in conjunction with mock-linking apparatus according to the present invention.

FIG. 2 shows a conventional industrial sewing machine 11, such as a UNION SPECIAL (Trade Mark) machine. Details of threads, bobbins, etc. are omitted for clarity. Firstly a ribbon 12 of trim 1 is made by machine sewing a batch of trims end-to-end. The ribbon 12 is fed through two sets of tensioning bars 13, 14 which impart a slight tension to the ribbon before it is fed into pre-folder 15 which folds the ribbon along kink 7 (indicated by a dashed line) wherein the back side of margin portion 6 faces outwardly. The prefolder is mounted in position by means of a plate 16 having slots 17 to receive screws which allow the prefolder to be height-adjusted relative to the machine base 18. The ribbon is then fed to a folder 19 which is also illustrated in FIGS. 5 to 7. The folder 19 has a slit 20 on one side thereof for threading the ribbon through the folder initially, and funnels towards folder outlet 21. The main portion 2 of ribbon 12 is folded face side towards face side as it passes through folder 19, but the folder outlet 21 is at an oblique angle to the rear side of the folder and is provided with a right angle extension piece 22, which reverses the fold imparted by the body of the folder as the ribbon passes around the right angle corner. Thus, when the trim emerges from the folder 19, the main portion 2 is folded in half, back side to back side.

The ribbon 12 of trim is therefore effectively folded twice by folding or tucking in margin portion 6 (along link 7) and folding the main portion 2 in half (along a line indicated by dotted line 23) over the tucked-in margin portion 6 to give a triple thickness of fabric. The extension piece 22 of folder 19 has a lower inwardly-curled lip 24 to receive a single thickness of the folded-over main portion 2 of the trim and an upper inwardly-curled lip 25 to receive a double thickness of folded-over overlapping main portion 2 and margin portion 6 of the trim. Alternatively the upper lip 25 is not inwardly-curled but extends straight out from the extension piece 22 (see dashed detail 25*a* in FIG. 5).

An unfinished edge of a knitted garment is introduced at the folder outlet 21 before the final fold-over (back side to back side) is effected by extension piece 22, i.e. the unfinished garment edge (not shown in FIG. 2) is sandwiched between a single thickness and a double thickness of the trim by being fed into gap 26 between inwardly-curled lips 24 and 25 of extension piece 22.

Once the ribbon of trim 1 has been threaded through pre-folder 15, folder 19 and under the foot 27 of the sewing machine, excess trim and in particular the end-to-end join between adjacent lengths of trim in the ribbon, are removed. An unfinished edge of a knitted garment is then introduced at the folder outlet 21 and mock-linking of the trim to the garment can commence. For example any of the following finishes may be achieved:

(a) Round collar, crew neck or turtle neck, with or without open shoulder seam,
(b) V-neck,
(c) Rib at bottom of garment,
(d) Arm hole trim in sleeveless garment or long sleeve cuffs,
(e) Waist rib for skirts.
(f) Rib trims for jackets, twinsets and cardigans.

Figure 8:
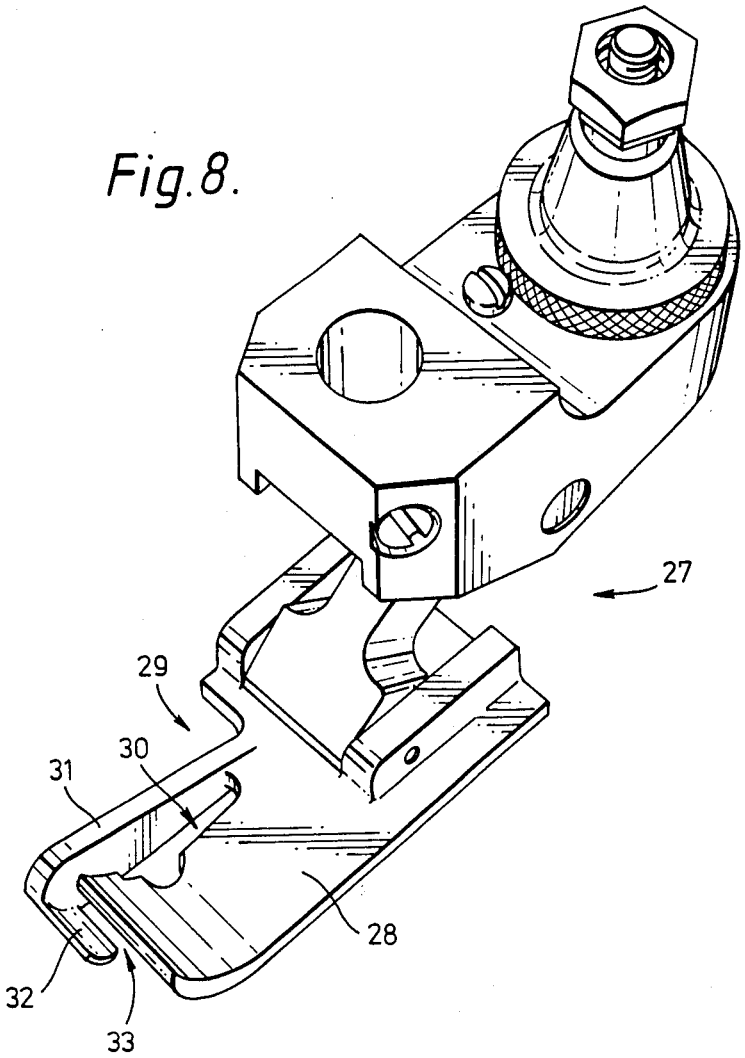
FIG. 8 shows an enlarged perspective view from above of a modified foot attachment for a sewing machine for use in the present invention.

FIG. 8 shows foot 27 of the sewing machine 11 which is specially modified for use in the present invention. It may, for example, be a UNION SPECIAL 56330 AK foot in which foot plate 28 is modified as follows. The width of the plate is shortened somewhat by cutting out a recess 29 to one side of the eye 30 of the foot. A small plate 31 is fixed to one side of eye 30 to act as a guard and which extends forwardly to support an inwardly-projecting guide lug 32 which defines a gap 33 between the underside of the foot plate 28 and the guide lug 32 sufficient to receive and guide a double thickness of the knitted trim comprising the edge of folded over margin portion 6 including the seam line as described above. It is important to align the seam line precisely with the needle path during machining, and to stretch the trim slightly in order to open the spaces 10, 10' along the same line.

In an alternative embodiment the forwardly-extending portion of the foot plate 28 is shortened somewhat to bring the leading edge of the foot and the guide lug 32 as close as possible to the needle path. A shortened foot plate of this type is illustrated in FIG. 2.

Figure 9:
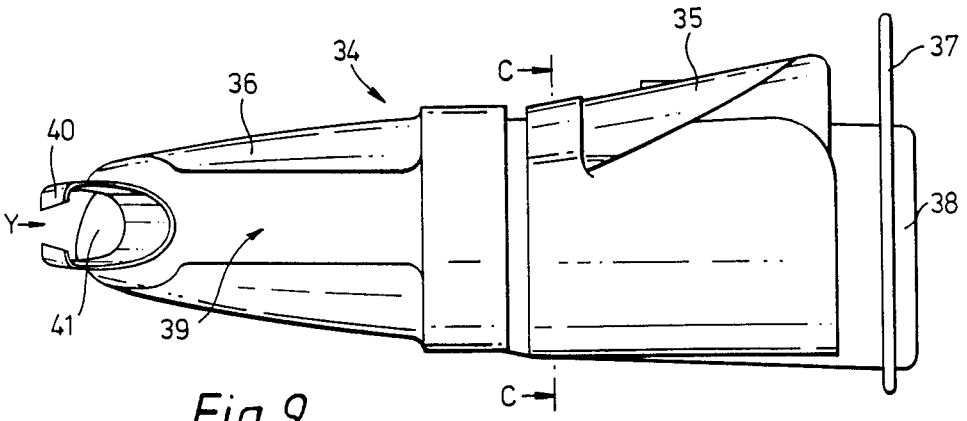
FIG. 9 shows a front elevation of an alternative combined pre-folder and folder for use in the present invention.
Figure 10:
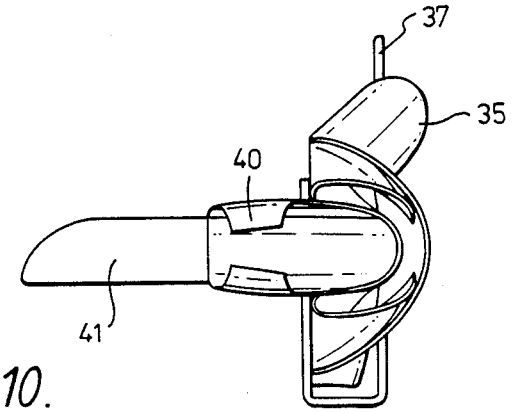
FIG. 10 shows an end elevation of the combination folder of FIG. 9, viewed in the direction of arrow Y.
Figure 11:
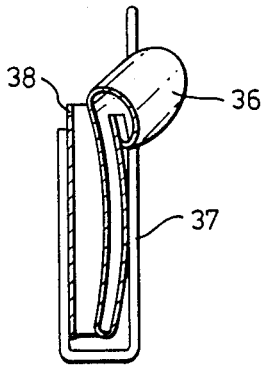
FIG. 11 shows a cross-section of the combination folder of FIG. 9 when viewed along section line C—C.

FIGS. 9 to 11 show an alternative combination folder 34 which comprises a pre-folder 35, corresponding to pre-folder 15 illustrated in FIG. 3, and a folder 36, corresponding to folder 19 illustrated in FIG. 5. A tensioning bar 37 is also mounted on a rear plate 38 of the combination folder 34. It will be seen from FIG. 11 that the pre-folder 35 differs only from the pre-folder 15 in having a slightly convex profile. The folder 36 has an open-ended slot 39 corresponding to slot 20 of folder 19, and an extension piece 40 extends from the folder outlet at a more oblique angle than is the case with extension piece 22 of folder 19. A wing 41 projects from the extension piece 40 to keep the folded trim in close alignment with the sewing machine foot.

During machining, a seam is stitched using chain stitching through the seam line of the trim referred to above at a distance of 1–2 mm from the folded edge, through the garment edge, and finally through the folded-over main portion 2 of the trim at a distance of about 5 mm from free edge 34 of the trim on the inside. The edge 34 of the trim is finished off during machine knitting in such as way as to provide a non-fraying edge or selvedge, but if necessary the inside edge of the trim when linked to the garment may be suitably finished to prevent fraying. When a length of trim from the ribbon 12 has been applied the whole way around an arm hole or neck hole of a garment, the ribbon is cut and the trim join finished in a manner known per se. It will be appreciated that the small degree of elasticity imparted to the kink 7 which includes the seam line facilitates the application of the trim to a curved garment edge and means that the trim is not unduly stretched.

We claim:

1. Apparatus for linking a knitted edging trim with an unfinished edge of a knitted garment, wherein the trim is in the form of a ribbon of weft-knitted yarn, double-knit, having two parallel longitudinal side edges defining a selvedge and a ravel edge, including a course of transfer stitching spaced from a side edge thereof to define a fold line, such that when the trim is folded over upon itself along the fold line, the folded edge of the trim then presents an adjacent seam line traversing outwardly protruding loops defining spaces therebetween, which apparatus comprises:

a sewing machine with a reciprocable needle adapted to perform chain-stitching, folding means defining a path through which the ribbon of trim may be advanced towards the machine, to firstly fold over a margin portion of the trim upon itself along said fold line, to secondly fold the thus folded trim in half so as to sandwich the said unfinished garment edge as the garment is fed adjacently past the folding means in the direction of the needle, such that the folded over margin portion of trim then lies above the garment edge and the seam line is aligned with the needle, a foot, attached to the sewing machine arranged substantially perpendicular to the path of the folding means, defining an eye through which the needle may reciprocate, and guide means forward of the eye adapted to advance and impart a slight stretch to the folded over margin portion of the trim in order to open out said spaces defining said seam line just prior to advancement of the seam line to the needle.

2. Apparatus according to claim 1 wherein the folding means comprise a pre-folder adapted to fold over the margin portion of the trim upon itself along said fold line, and a generally funnel-shaped folder adapted to fold the thus folded trim in half, which funnel defines an outlet disposed at an angle of approximately 90° to 120° to the axis of the funnel.

3. Apparatus according to claim 2 in which the foot comprises a foot plate defining an eye through which the needle may reciprocate wherein the said guide means are located forwardly of the eye on the underside of the foot plate.

4. Apparatus according to claim 3 in which said guide means comprise an inwardly-projecting lug extending transversely from the underside of the foot plate to define a gap between the foot plate and the lug sufficient to receive a double thickness of the trim.

* * * * *